United States Patent [19]

Mulrooney

[11] 4,449,299

[45] May 22, 1984

[54] COMBINATION SCRAPING PLANE

[76] Inventor: James F. Mulrooney, R.F.D. 2 Box 279, Epping, N.H. 03042

[21] Appl. No.: 306,365

[22] Filed: Sep. 28, 1981

[51] Int. Cl.[3] ..... B27G 17/00

[52] U.S. Cl. ..... 30/169; 30/170; 145/19

[58] Field of Search ..... 30/169, 170; 145/5 R, 145/19

[56] References Cited

U.S. PATENT DOCUMENTS

| | | | |
|---|---|---|---|
| 987,706 | 3/1911 | Drew | 30/170 |
| 1,787,576 | 1/1931 | Haugsbak | 145/19 |
| 2,484,476 | 10/1949 | Teigland | 145/5 R |

FOREIGN PATENT DOCUMENTS

| | | | |
|---|---|---|---|
| 953182 | 9/1947 | France | 30/170 |
| 48924 | 10/1909 | Switzerland | 30/170 |
| 21666 | of 1908 | United Kingdom | 30/170 |
| 802854 | 10/1958 | United Kingdom | 30/169 |

*Primary Examiner*—Jimmy C. Peters
*Attorney, Agent, or Firm*—Donald W. Meeker

[57] ABSTRACT

A primary elongated handle conforms to the shape of the hand of the user and is provided with a blade protruding beyond one end. Equal lateral protrusions of the body of the primary handle at the blade end give the tool an overall "T" shape. Within the protruding portion, perpendicular to the primary handle, a half-cylindrical concavity houses a matching half-cylindrical blade. A straight blade edge, longitudinally and laterally protruding beyond the handle periphery and raked indentations of the front corners of the primary handle combine to permit complete access of the blade into corners and intersecting work surface edges. A nut and bolt through the handle and through a slot in the blade permits adjustment by rotation of blade angle and extension. A narrow central portion and lateral extensions of the primary handle toward the ends create a fulcrum effect for optimum force application and balance. Through the non-blade end, a vertical opening provided with notches and a set screw admits a notched T-shaped combination foot/handle. Inserted through the top it serves as a facilitating handle. Inserted through the bottom, it serves as an adjustable foot to regulate the angle of the tool used as a scraper. An additional u-shaped handle may be inserted in notches on top of the primary handle to keep the users hand away from the work and give added leverage to the tool used as a plane. Altering the position of the tool in the hand and the angle of the tool to the work transforms the tool instantly and reversibly between a scraper and a plane. Force is applied in front of the blade.

9 Claims, 10 Drawing Figures

COMBINATION SCRAPING PLANE

DESCRIPTION

TECHNICAL FIELD

My invention relates to cutting tools, in particular to scrapers and planes for wood, and in the instant case to a combined scraper and plane which reversibly provides a scouring abrasive cut and a shearing level planing cut, adjustable to different depths.

BACKGROUND ART

Normally, two separate tools are required for the two separate functions: scraping wood and planing wood. Conversion of a conventional scraper to a plane would require additional equipment or modifications. Conversion of a conventional plane to a scraper would require major redesign. Without redesign conventional conversions produce unsatisfactory results from the modified tool.

Edge scrapers generally have no balance other than that which the user imparts to them. Such a lack of leverage produces a generally uneven cut; especially in finishing situations.

Prior art scrapers and planes tend to chip, tear, gouge or overbite the wood creating very uneven surfaces. Planes had a tendency to chatter in use and exhibit a rocking action because of a center-mounted blade, so that the force of action tended to be applied unevenly from behind the blade location.

Bulky blade tensioning means often protrude beyond the blade in other scrapers, and planes with center-mounted blades have a substantial portion of the body of the tool extending beyond the blade. In both cases access to work up to the edge of a piece is prevented when the piece intersects another.

Controlled adjustability of the handle angle has not been provided in prior art.

DISCLOSURE OF INVENTION

The present invention provides a tool which converts instantly from a scraper to a plane and, conversely, from a plane to a scraper, with no contrivances by repositioning the tool on the work. Optimum efficiency and control is maintained in using the tool in either mode because of blade location and orientation, and handle construction to provide a great scraper and an excellent plane.

Control features of the present invention produce a smooth safe true cut in the wood without marring the surface with indentations. A strong curved blade with a straight cutting edge is tensioned for maintaining precision straightness. The blade is end-mounted at 45 degrees downward from the horizontal axis pointing away from the end of the handle opposite to the working direction to eliminate overbite. With a maximum mechanical advantage, force is applied to the handle in front of the edge-mounted blade along the axis of the direction of the work, so that the blade scours the surface of the wood following smoothly behind the handle with a level thrust action, thereby eliminating overbite, chatter, jamming, rocking and skipping actions of the tool. Pushing the tool with the bladed heel end of the tool riding securely on the work surface provides excellent shaving control in both skilled and unskilled hands. The long uninterrupted flat bottom of the tool enhances control and provides a distinct mechanical advantage with an end mounted blade by providing greater action for the entire length of the handle. A fulcrum effort is created by providing a handle with a tapered portion in the center to be positioned between the thumb and forefinger of the user and pivot by force applied on the blade end. The fulcrum effect combined with an indentation to hook the forefinger and a protrusion for pressing the thumb produce optimum control of the invention when used as a scraper.

Complete access to the work is accomplished by providing a blade which protrudes beyond the end of the handle both longitudinally and transversely so that the tool reaches into edges and corners of the work. This tensioning means of providing a streamlined inwardly pointing tension bar (applying opposite pressure on the blade to that of the tightening screw) so that no protrusions interfere with blade access to the work. Additional access is afforded by the fact that the cross portion at the working end of the handle is raked on the two sides to eliminate the front corners. Joinery, moldings, fine beads and troublesome textured architraves of painted woodwork can all be scraped effectively and flatwork in corners can be planed effectively.

Providing a curved tensioned blade which is adjustable in depth and angle and further providing the ability to change the entire handle angle with an adjustable foot produces a great range of light to heavy cutting performance for much greater working flexibility than previously provided.

The adjustable foot may be inverted in the handle to provide a facilitator for gripping the tool in a controlled way without having the hand close to the work. Another add-on longer handle further facilitates the use of the tool with greater safety and leverage.

BRIEF DESCRIPTION OF THE DRAWINGS

These and other details and advantages of my invention will be described in connection with the accompanying drawings, which are furnished only by way of illustration and not in limitation of the invention, and in which.

BEST MODE FOR CARRYING OUT THE INVENTION

Figure 1:
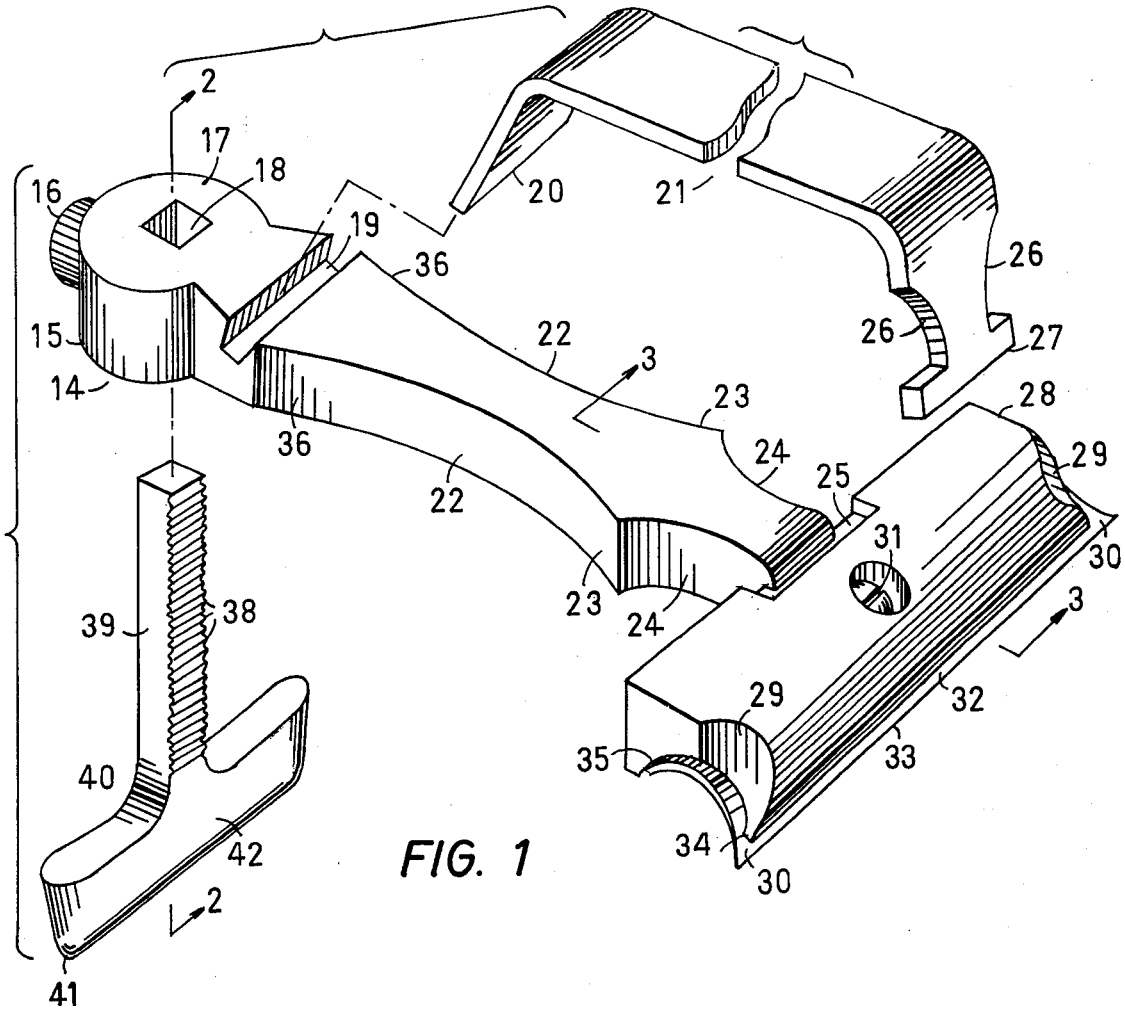
FIG. 1 is a perspective view of the preferred embodiment of the invention showing additional components which may be applied to the invention.

In FIG. 1 the preferred embodiment of the invention is a cutting tool 14 which serves alternately as a hooked cabinet scraper or a scraping leveling plane for working on wood. Facilitating attachments, described in detail later in the document, include an adjustable reversible foot/handle 40 and a D-shaped facilitating handle 21.

The cutting tool 14 comprises an elongated handle 15 and an end cross portion 28 extending laterally an equal distance on both sides of the elongated handle 15. Cross portion and handle which are securely interconnected may be fabricated as one piece from a rigid plastic, wood or other rigid and strong material.

Figure 3:
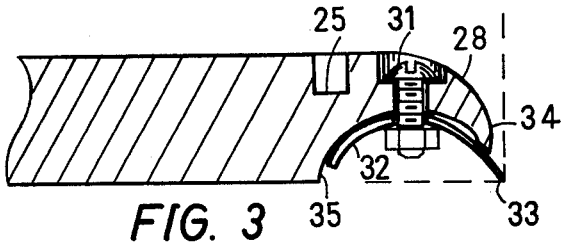
FIG. 3 is a partial longitudinal sectional view through the working end of the invention in a corner taken through 3—3 of FIG. 1.
Figure 4:
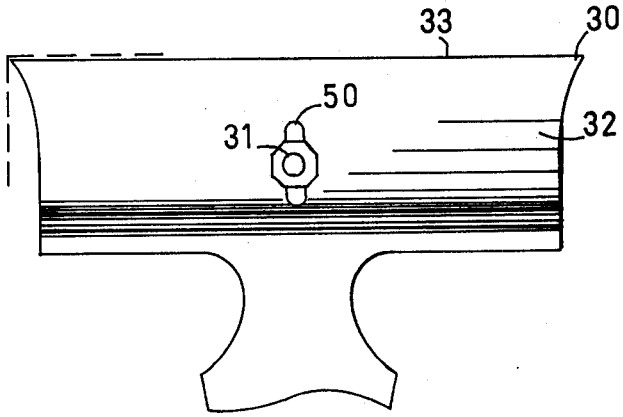
FIG. 4 is a partial bottom view of the working end of the invention in a corner.

In FIGS. 1, 3 and 4 a cutting blade 32 of steel is adjustably attached to the cross portion 28 at the end of the handle. The cross portion 28, in the preferred embodiment, is provided with a half-cylindrical concavity 25 in the lower portion extending transversely across the handle axis for the entire length of the cross portion 28. A tension bar 34 protrudes into the cylindrical concavity for its entire length. The steel blade 32, formed into a half cylinder is adjustably secured within the concavity for its entire length. The steel blade 32, formed into a half cylinder 15 is adjustably secured within the concavity 35 by screw and nut 31 through a hole in the center of the cross portion 28 and through a slot 50 in FIG. 4 extending transversely across the blade 32, which slot permits rotation of the blade 32 within the concavity 35 to alter the amount of protrusion and angle of the blade.

With screw and nut 31 tightened securely most of the convex surface of the blade is in contact with the concavity 35 of the cross portion 28. The protruding tension bar 34 causes the protruding end of the blade to be forced away from the cylindrical concavity thereby creating tension in the blade. Combining a cylindrical blade with a tensioned straight cutting edge 33 creates a very strong rigid cutting blade to prevent the bending of the cutting edge and produce even cuts without chatter. The minimum angle for the blade was determined to be 45 degrees from the horizontal to prevent overbite, tearing or gouging. With the blade set at a protrusion distance for a depth cut of 1/16" to 1/32" the blade angle is 45 degrees. Rotating the blade outwardly increases the cutting depth and increases the blade angle for greater efficiency in deep scouring and scraping.

A streamlined inwardly directed tension bar 34 does not block access to the blade, permitting the cutting edge 33 of the blade to extend beyond the end of the handle for ready access to the work. Further blade accessibility is provided by extending the side edges 30 of the blade beyond the lateral edges of the cross portion 28 and by providing raked indentations 29 in the front edges of the cross portion 28 eliminating any protruding front corners of the handle. All these features combine to permit the tool to work as a scraper or plane over an entire work surface right up to edges and corners, even at orthogonal joints as in FIGS. 3 and 4.

As seen in FIGS. 1 and 5-8, the elongated handle 15 is constructed to conform efficiently to the hand of the user for optimum function and versatility. A central fulcrum portion 22 of the handle is sufficiently narrow in width to permit the fulcrum portion to rest comfortably between the thumb and forefinger of the user as in FIG. 5.

Figure 6:
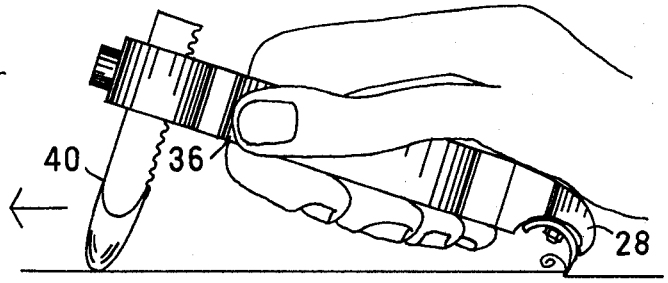
FIG. 6 is a side elevational view of the invention used as a universal ships scraper in the hand of the user employing a strong pushing action for scouring.
Figure 8:
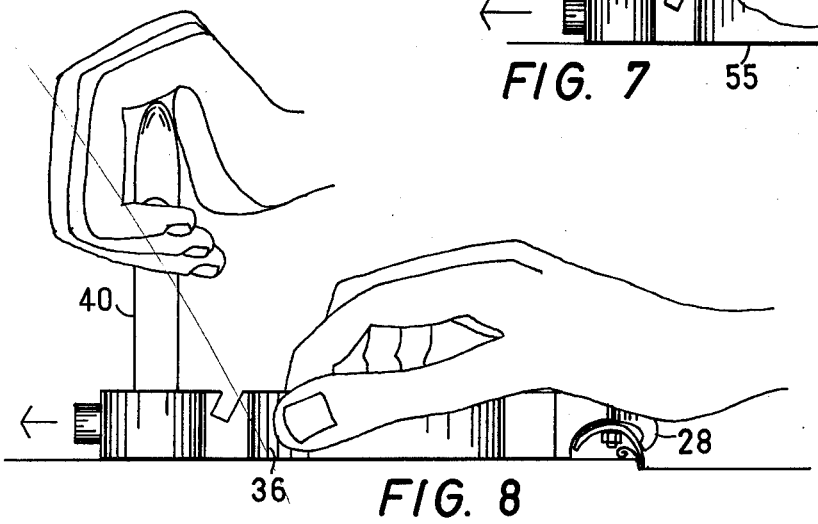
FIG. 8 is a side elevational view of the invention with facilitating adjustable handle used as a plane in the hands of the user employing a pushing motion with both hands.

From the central fulcrum portion outwardly toward both ends the handle broadens in width to produce flared portions 23 and 36 against which the user applies force to push the tool as in FIGS. 6 and 8.

Figure 5:
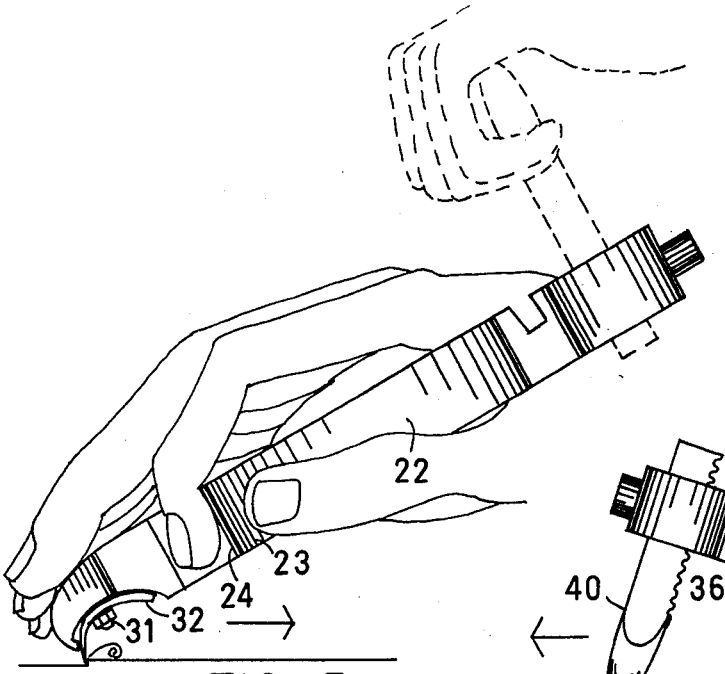
FIG. 5 is a side elevational view of the invention used as a scraper in the hand of the user employing a controlled pulling action.
Figure 7:
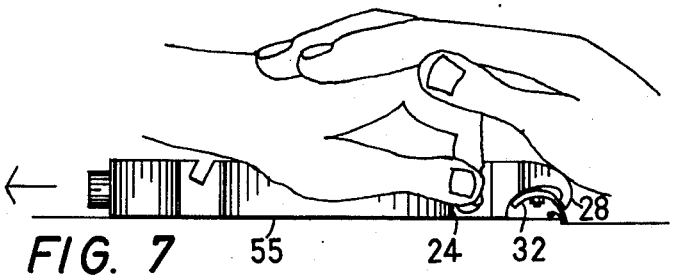
FIG. 7 is a side elevational view of the invention used as a plane in the hands of the user employing a pulling action with the left hand and a pushing action with the right hand.

At the working end, adjacent to the blade-holding cross portion 28, an indentation 24 is provided laterally on both sides of the handle. In FIG. 7 the thumb and forefinger of the user are hooked into the lateral indentations 24 to pull the tool. In FIG. 5 just the index finger is hooked into an indentation 24 to pull the invention.

With the exception of the blade-holding cross portion 28, in FIG. 7, the entire handle bottom 55 is a flat surface to rest firmly against the work surface for good control and a uniform leveling cut. With the blade 32 at the end of the invention following behind the handle against which the force is applied a smooth level controlled planing action results with no gouging or chattering.

Figure 2:
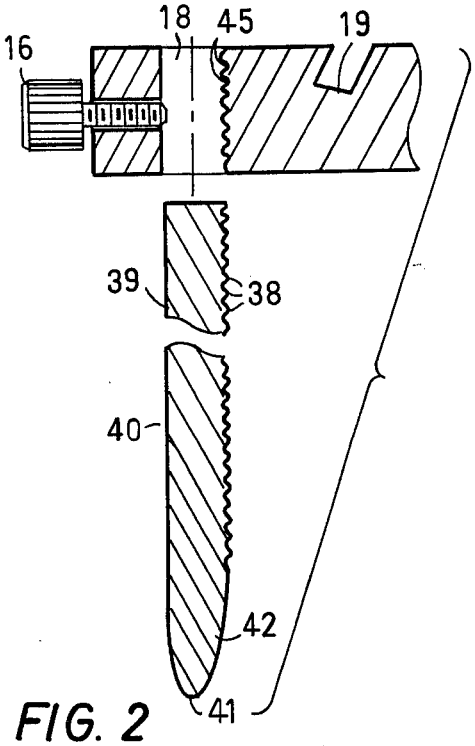
FIG. 2 is a sectional partial view of the non-working end of the invention and additional adjustable foot taken through 2—2 of FIG. 1.

Near the end of the handle opposite the blade end, a circular end portion 17 of the handle is provided with a rectangular opening 18 vertically through the handle. As indicated in FIG. 2 the vertical opening 18 is provided along the wall closest to the blade with a series of horizontal parallel teeth or ridges 45 spaced 1/16" apart. Through the end wall of the handle, a threaded opening is provided from the end into the vertical shaft. Through the end opening a set screw 16 is threaded.

A combination foot/handle 40 is provided with an elongated rectangular portion 39 provided along its length on one side with spaced horizontal ridges 38 designed to match those 45 within the vertical opening 18 in the handle. Slightly smaller in cross-sectional area than the handle opening 18 the elongated portion 39 slides into the handle opening 18 from the top or bottom of the handle. The set screw 16 is tightened against the elongated portion 39 to engage the two series of ridges 38 and 45 and thereby secure the foot/handle within the opening 18 in the handle. The end portion 42 of the foot/handle protrudes laterally to form a T configuration which is easy to grasp in the hand of the user and which is further provided on its outer end with a rounded edge portion 41 which slides easily along the work as a low friction contact point when the piece is used as a foot for a scraper as in FIG. 6.

A work-end transverse notch 25 is provided in the top of the cross-portion 28 of the handle. An angled transverse notch 19 is provided in the top of the handle opposite to the blade end. A facilitating handle 21 roughly in the shape of block letter D when installed on the handle is fabricated of a very flexible, non-breakable plastic. The plastic facilitating handle 21 may be a flat piece of stock scored and bent to form orthogonal insertion arm 27 to be placed in the work end notch 25 in the handle. The orthogonal insertion arm 27 is further provided with side notches 26 for finger access to transverse notches 24 on the handle. The opposite end of the facilitating handle may be scored and bent to form a skewed insertion arm 20 which fits into the angled notch 19 on the handle, to form a facilitating handle which elevates the hand of the user from the work and provides added leverage.

The actual distance between insertion portions 20 and 27 on the foot/handle exceeds the distance between top notches on the handle. By placing the blade on a horizontal surface against an intersecting vertical surface and inserting the orthogonal arm 27 in the work end notch 25 the facilitating handle may be pushed forward and bent to match the skewed arm 20 with the angled notch 19 for insertion therein. When in place the cross arm of the facilitator handle slopes at approximately 15 degrees downward from the working end for optimum efficiency.

In use the invention converts instantly and reversibly from a scraper to a plane by merely repositioning the tool to change the orientation of the tool to the work by changing the way the tool is gripped in the hand of the user.

In FIG. 5 the invention is used as a precision scraper with the narrow central fulcrum portion 22 of the handle resting on the hand between the thumb and forefinger of the user, establishing a fulcrum effect with three fingers bearing down over the blade, the index finger hooked into the indentation 24 and the thumb against the laterally flared portion 23 to pull the tool (in the direction of arrow) as an open-bladed scouring scraper with control and balance. The second hand of the user may be cupped over the first on the tool or grip the combined foot/handle applied to the top of the tool handle (as indicated by broken lines) for added force and control.

In FIG. 6 the tool is pushed (in the direction of the arrow) as a universal ships scraper with the butt of the user's palm pushing on the cross portion 28 holding the blade and the thumb and forefingers pushing the carefully flared sides 36 of the handle. The combined foot/handle 40 is installed under the handle with the low friction rounded end 44 resting on the work to act as an adjustable foot to support the tool at a desired angle. The other hand may be pressed on top of the hand holding the tool for extra force and control.

In FIG. 7 the invention is used as a precision leveling plane with the flat bottom 55 of the invention resting on the work. One hand pulls (in the direction of the arrow) with the thumb and forefinger hooked into lateral indentations 24. The butt of the palm of the other hand pushes against the cross-portion 28 of the invention applying force directly over in line with and in front of the scraping blade 32.

In FIG. 8 the invention is used as a scraping plane with the combined foot/handle 40 installed above the invention pushed (in the direction of the arrow) by one hand while the butt of the other hand pushes directly against the cross portion 28 with the thumb and forefinger applying force to the lateral extensions 36.

In all of these applications, the unique method of tensioning the blades with a complete tension bar pressing against the blade prevents the wood shavings from fouling the head of their tool.

The facilitating handle 21 may be used in any of these applications of the invention with the user's hand elevated away from the work rather than being placed directly on the lower handle.

Figure 9:
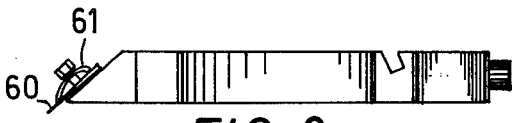
FIG. 9 is a side elevational view of an alternate embodiment of the invention with a front-mounted blade.

In FIG. 9 an alternate embodiment of the invention provides a straight blade 60 mounted on the front edge of the handle with a spring metal 61 tensioning means screwed against the blade.

Figure 10:
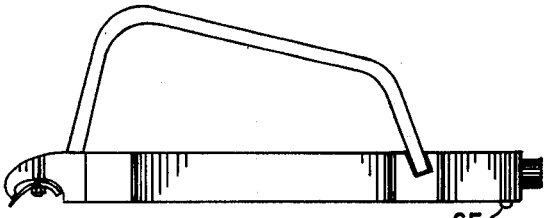
FIG. 10 is a side elevational view of an alternate embodiment of the invention with a bottom rear roller.

In FIG. 10 another alternate embodiment shows a wheel or roller bearing 65 mounted with part of the wheel or bearing 65 protruding downward from the non-work end of the invention to reduce friction of the bottom with the work surface.

It is understood that the preceding description is given merely by way of illustration and that various modifications may be made thereto without departing from the spirit of the invention as claimed.

I claim:

1. In hand tools, a combined plane and scraper comprising:

a primary handle constructed to conform to the shape of the hand of the user;

a blade adjustably secured to one end of the primary handle provided with a tensioning means for the blade, the cutting edge of which blade extends below the bottom of the handle and beyond the end of the handle and which blade is acutely angled downwardly from the horizontal centerline of the primary handle;

a vertical opening through the primary handle near the non-blade end thereof;

a convertible foot/handle which is adjustably secured within the vertical opening in the primary handle, wherein the convertible foot/handle protrudes above the main body of the primary handle to form an auxillary facilitating handle;

an adjustable tightening means through the body of the primary handle into the opening to secure the convertible foot/handle.

2. The invention of claim 1 further comprising:

at the end of the blade end of the primary handle, a downwardly facing transverse concavity of roughly half-cylindrical shape;

and wherein the blade is a metallic plate formed into a roughly half-cylindrical shape to conform to the concavity of the primary handle and secured rotatably therein, which blade is provided with a straight cutting edge portion that protrudes beyond the periphery of the primary handle;

and wherein an unobtrusive tensioning means for the blade comprises a transverse bar protruding downwardly from the blade end of the primary handle and contacting the blade adjacent to the cutting edge providing an inward thrust and rigidity to the blade, forcing the cutting end of the blade away from contact with the concavity.

3. The invention of claim 1 wherein the convertible foot/handle alternately protrudes below the main body of the handle to form an adjustable foot support for the invention used as an adjustable scraper.

4. In a hand tool, a plane comprising:

a primary handle;

a blade adjustably secured to and protruding downwardly from one end of the primary handle;

wherein the primary handle is so constructed that the work force is applied in advance of the point of blade action in the direction of travel of the plane;

a vertical opening through the primary handle near the non-blade end thereof;

a convertible foot/handle which is adjustably secured within the vertical opening in the primary handle, wherein the convertible foot/handle protrudes above the main body of the primary handle to form an auxillary facilitating handle;

an adjustable tightening means through the body of the primary handle into the opening to secure the convertible foot/handle.

5. The invention of claim 4 wherein the convertible foot/handle alternately protrudes below the main body of the handle to form an adjustable foot support for the invention used as an adjustable scraper.

6. The invention of claim 4 further comprising:

at the end of the blade end of the primary handle, a downwardly facing transverse concavity of roughly half-cylindrical shape;

and wherein the blade is a metallic plate formed into a roughly half-cylindrical shape to conform to the concavity of the primary handle and secured rotatably therein, which blade is provided with a straight cutting edge portion that protrudes beyond the periphery of the primary handle;

and wherein an unobtrusive tensioning means for the blade comprises a transverse bar protruding downwardly from the blade end of the primary handle and contacting the blade adjacent to the cutting edge providing an inward thrust and rigidity to the blade, forcing the cutting end of the blade away from contact with the concavity.

7. A cutting tool comprising:

an elongated primary handle comprising a flat portion on the bottom of the primary handle for the majority of the length of the primary handle, a laterally narrow portion near the midpoint of the primary handle, and outwardly extended lateral portions near the ends of the primary handle;

lateral protrusions extending beyond the body of the primary handle at one end thereof;

a blade adjustably secured to the protruding portion which blade is provided with a cutting edge extending longitudinally beyond the end of the primary handle and below the bottom of the handle;

lateral indentations of the primary handle adjacent to the protruding portions;

a removable means of securing the blade to the primary handle to allow adjustment of the length of blade extension;

a means of tensioning the blade;

a vertical opening through the primary handle near the non-blade end thereof;

a convertible foot/handle which is adjustably secured within the vertical opening in the primary handle, wherein the convertible foot/handle protrudes above the main body of the primary handle to form an auxillary facilitating handle;

an adjustable tightening means through the body of the primary handle into the opening to secure the convertible foot/handle.

8. The invention of claim 7 wherein the convertible foot/handle alternately protrudes below the main body of the handle to form an adjustable foot support for the invention used as an adjustable scraper.

9. The invention of claim 7 further comprising:

at the end of the blade end of the primary handle, a downwardly facing transverse concavity of roughly half-cylindrical shape;

and wherein the blade is a metallic plate formed into a roughly half-cylindrical shape to conform to the concavity of the primary handle and secured rotatably therein, which blade is provided with a straight cutting edge portion that protrudes beyond the periphery of the primary handle;

and wherein an unobtrusive tensioning means for the blade comprises a transverse bar protruding downwardly from the blade end of the primary handle and contacting the blade adjacent to the cutting edge providing an inward thrust and rigidity to the blade, forcing the cutting end of the blade away from contact with the concavity.

* * * * *